US007783479B2

(12) United States Patent
Iser et al.

(10) Patent No.: US 7,783,479 B2
(45) Date of Patent: Aug. 24, 2010

(54) SYSTEM FOR GENERATING A WIDEBAND SIGNAL FROM A RECEIVED NARROWBAND SIGNAL

(75) Inventors: Bernd Iser, Ulm (DE); Gerhard Uwe Schmidt, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 1059 days.

(21) Appl. No.: 11/343,938

(22) Filed: Jan. 31, 2006

(65) Prior Publication Data

US 2006/0190245 A1 Aug. 24, 2006

(30) Foreign Application Priority Data

Jan. 31, 2005 (EP) ..... 05001959

(51) Int. Cl.
*G10L 19/10* (2006.01)

(52) U.S. Cl. ..... 704/219

(58) Field of Classification Search ..... 704/219
See application file for complete search history.

(56) References Cited

U.S. PATENT DOCUMENTS

| | | | | |
|---|---|---|---|---|
| 6,681,202 | B1 | 1/2004 | Miet et al. | 704/214 |
| 7,174,135 | B2 * | 2/2007 | Sluijter et al. | 455/72 |
| 7,630,881 | B2 * | 12/2009 | Iser et al. | 704/203 |
| 2004/0166820 | A1 | 8/2004 | Sluijter et al. | 455/221 |

FOREIGN PATENT DOCUMENTS

EP 0 732 687 A2 9/1996

OTHER PUBLICATIONS

Iser, Bernd et al., "Neural Networks Versus Codebooks in an Application for Bandwidth Extension of Speech Signals," *Eurospeech 2003 Geneva*, European Conference on Speech Communication and Technology, 2003, pp. 565-568.

Miet, G. et al., "Low-band Extension of Telephone-Band Speech," *IEEE*, International Conference on Acoustics, Speech, and Signal Processing Proceedings, 2000, pp. 1851-1854.

* cited by examiner

*Primary Examiner*—Susan McFadden
(74) *Attorney, Agent, or Firm*—Sunstein Kann Murphy & Timbers LLP

(57) ABSTRACT

A system for use in providing a wideband signal from a received narrowband signal is set forth. The system comprises an extracted narrowband feature vector that corresponds to at least one characteristic of the narrowband signal. A narrowband codebook having one or more narrowband codebook index vectors is also employed, where each narrowband codebook index vector is associated with one or more corresponding narrowband codebook parameters. An analyzer is provided to correlate the extracted narrowband feature vector with an entry in the narrowband codebook. More particularly, the analyzer is responsive to the extracted narrowband feature vector to identify the narrowband codebook feature index vector that best matches the extracted narrowband feature vector. A signal mapper is provided to execute a mapping function of the extracted narrowband feature vector and/or the narrowband codebook index vector identified by the analyzer. In executing the mapping function, the signal mapper uses mapping parameters that correspond to the narrowband codebook entry associated with the narrowband codebook index vector identified by the analyzer. The signal mapper generates at least one estimated wideband feature vector through execution of the mapping function. The estimated wideband feature vector is used by a signal generator to generate a wideband signal that corresponds to an extended bandwidth version of the received narrowband signal.

43 Claims, 3 Drawing Sheets

SYSTEM FOR GENERATING A WIDEBAND SIGNAL FROM A RECEIVED NARROWBAND SIGNAL

BACKGROUND OF THE INVENTION

1. Priority Claim

This application claims the benefit of priority from European Patent Application No. 05001959.5, filed Jan. 31, 2005, which is incorporated by reference.

2. Technical Field

The present invention relates to a system and corresponding method for generating a wideband signal from a received narrowband signal, such as acoustic speech signals transmitted over a telephone system.

3. Related Art

The quality of transmitted audio signals often suffers from bandwidth limitations. Unlike face-to-face speech communication, that may take place over a frequency range from approximately 20 Hz to 18 kHz, communication by landline telephones and cellular phones is characterized by a substantially narrower bandwidth. For example, telephone audio signals, in particular, speech signals, are generally limited to a narrow bandwidth between 300 Hz-3.4 kHz. The audio components of speech signals that are lower and higher end frequency are simply not transmitted thereby resulting in a degradation in speech quality compared to face-to-face speech communications. This may cause problems in properly reproducing the speech at the receiving end and result in reduced intelligibility of the speech signal.

Several approaches have been taken to address such audio transmission problems. For example, several digital networks have been developed that have a higher speech transmission bandwidth than conventional telephone systems. Digital networks, such as the Integrated Service Digital Network (ISDN) and the Global System for Mobile Communication (GSM), have higher bandwidth speech transmission channels that allow for transmission of signal components with frequencies below and above the limited bandwidth of conventional systems. However, the higher bandwidth transmission channels result in a corresponding increase in network complexity and costs.

Other solutions have likewise been proposed to address the insufficiencies of narrowband speech transmissions. One proposed solution consists in combining two or more narrowband speech channels for the transmission of a single speech signal. However, this solution places significant demands on the telephone network and substantially reduces the amount of communications traffic that may be carried by existing equipment.

Another proposed solution consists in the utilization of speech codebooks at the receiver to construct wideband speech signals from received narrowband speech signals. In accordance with this approach, the receiver includes a narrowband codebook containing narrowband signal vector parameters and a corresponding wideband codebook containing wideband codebook signal vector parameters. The codebooks are generated to define the correspondence between narrowband and wideband spectral envelope representations of speech signals. In practice, an analysis of the received narrowband speech signal is used to select which of the narrowband signal vector parameters of the narrowband codebook provide the best correspondence with the received narrowband speech signals. The selected narrowband signal vector parameter is then used to select a corresponding wideband codebook signal vector parameter of the wideband codebook. In turn, the selected wideband codebook signal vector parameter is used to generate a wideband speech signal that corresponds to the received narrowband speech signal.

Even with the use of codebooks, the quality of the resulting wideband speech signals may be somewhat deficient. For example, abrupt changes from one entry of the narrowband member of the pair of codebooks to another may result in perceptible discontinuities and artifacts within the sequence of generated speech signals. Additionally, the number of wideband codebook entries may be limited and result in perceptible discontinuities in the generated wideband speech signal. Still further, the computing power required to execute such bandwidth extension methods is rather high, particularly when relatively large codebooks are employed. Thus, there is a need for improvements in systems that generate wideband acoustic signals from received narrowband acoustic signals.

SUMMARY

A system for use in providing a wideband signal from a received narrowband signal is set forth. The system includes an extracted narrowband feature vector that corresponds to at least one characteristic of the narrowband signal. A narrowband codebook having one or more narrowband codebook index vectors is also employed, where each narrowband codebook index vector is associated with one or more corresponding narrowband codebook parameters. An analyzer is provided to correlate the extracted narrowband feature vector with an entry in the narrowband codebook. More particularly, the analyzer is responsive to the extracted narrowband feature vector to identify the narrowband codebook feature index vector that best matches the extracted narrowband feature vector. A signal mapper is provided to execute a mapping function of the extracted narrowband feature vector and/or the narrowband codebook index vector identified by the analyzer. In executing the mapping function, the signal mapper uses mapping parameters that correspond to the narrowband codebook entry associated with the narrowband codebook index vector identified by the analyzer. The signal mapper generates at least one estimated wideband feature vector through execution of the mapping function. The estimated wideband feature vector is used by a signal generator to generate a wideband signal that corresponds to an extended bandwidth version of the received narrowband signal.

The system also may include a stability analyzer that is adapted to check the stability of a filter function constituted by the estimated wideband feature vector. The stability analyzer selects use of a stable wideband feature vector for generation of the wideband signal when the filter function constituted by the estimated wideband feature vector is unstable, and selects use of the estimated wideband feature vector for generation of the wideband signal when the filter function constituted by the estimated wideband feature vector is stable. The system may include a wideband codebook to provide the stable wideband feature vectors, when necessary. The narrowband codebook index vector identified by the analyzer may be used to select which wideband codebook entry is used to provide the stable wideband feature vector when the stability analyzer detects an unstable filter function.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
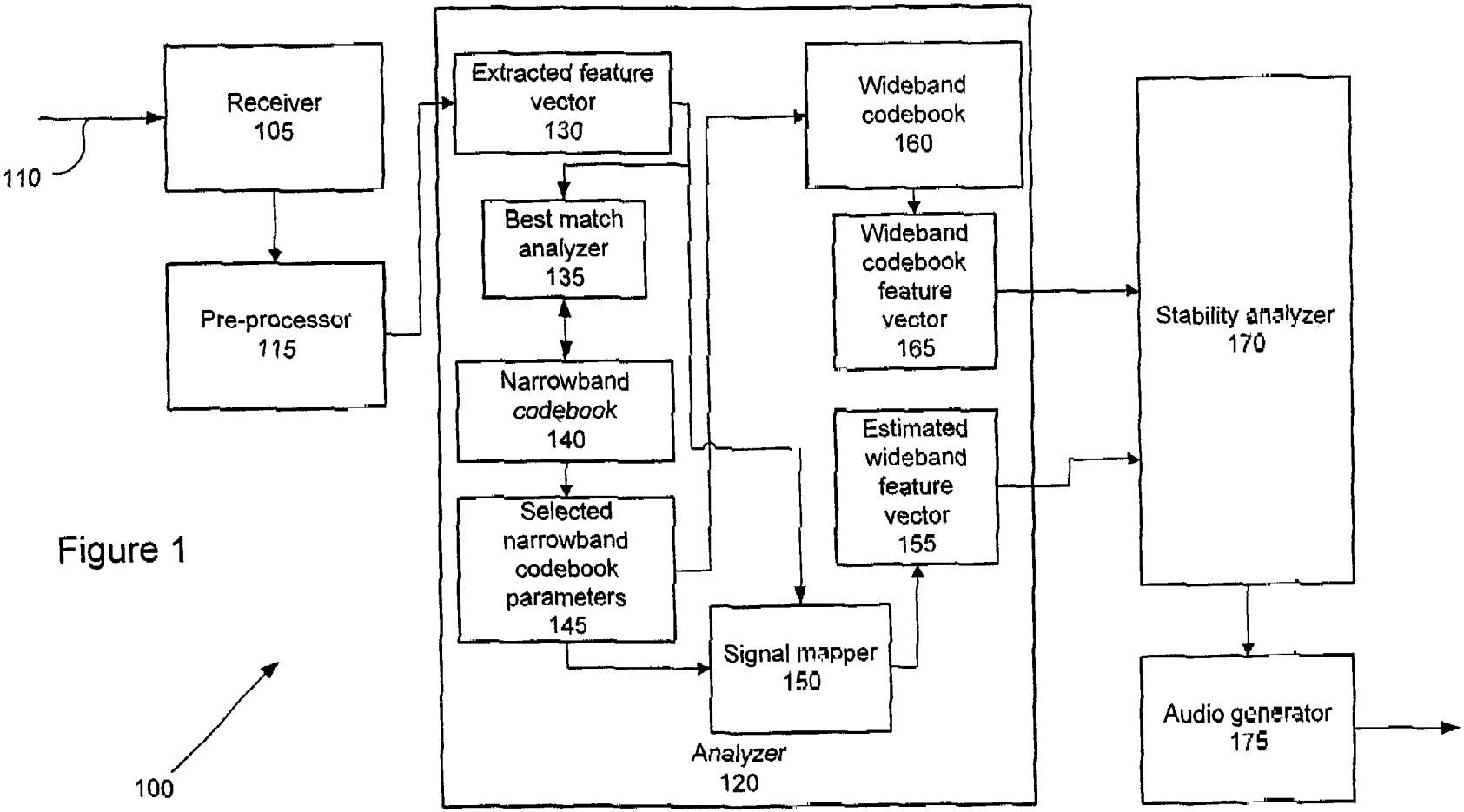
FIG. 1 is a block diagram of a system that may be used to generate wideband signals from received narrowband signals.

One example of a system that may be used to generate wideband acoustic signals from received narrowband acoustic signals is shown in FIG. 1. More particularly, the system 100 may be used to generate analog signals that have a larger frequency range than the frequency range of the corresponding received analog signals. As such, whether a signal is a wideband signal or a narrowband signal is dependent on its relation to the other.

System 100 includes a receiver 105 that is adapted to receive narrowband signals, over a channel 110. Signals received over the voice channel 110 may comprise analog speech signals that have a limited bandwidth, such as those transmitted over a conventional telephone network, a cellular telephone network, a speech headset, or the like. Alternatively, receiver 105 may comprise a digital receiver that is adapted to receive digital signal representations of narrowband audio signals over channel 110. Channel 110 may comprise a wired or wireless medium thereby making the system 100 suitable for use in cellular networks, hands-free audio systems such as those found in vehicles, as well as conventional telephone systems.

The output of receiver 105 may be provided to the input of a pre-processor 115, where the received signal may be subject to processing through, for example, a Fast Fourier Transform. Pre-processor 115 may additionally, or alternatively, execute other signal processing operations. These operations may include transformation of the received signal to its corresponding cepstral representation, transformation of the received narrowband signal to its corresponding line spectral frequency representation, generation of predictor coefficients from the received signal, and/or generation of a spectral envelope corresponding to the received narrowband signal.

The output of the pre-processor 115 may be provided to the input of an analyzer 120 along an extracted feature vector channel 125. Channel 125 may be used to provide an extracted feature vector, shown generally at 130, to the analyzer 120. The extracted feature vector 130 corresponds to at least one characteristic of the narrowband audio data signals that are generated from the narrowband acoustic signals received over channel 110. The particular form of the extracted feature vector 130 and its relationship to the original narrowband acoustic signal is dependent on the type and extent of processing executed by the pre-processor 115 and/or receiver 105.

The extracted feature vector 130 is made available for use by a best match analyzer 135. The best match analyzer 135 compares the extracted feature vector 130 with the entries in a narrowband codebook 140. The entries in the narrowband codebook 140 may be indexed, for example, with a predetermined set of narrowband codebook vectors that generally correspond to the range of extracted feature vectors that are expected to be derived from the acoustic signals received on channel 110. The narrowband codebook vector index entries may correspond to the spectral envelopes that are expected on channel 110. In operation, the best match analyzer 135 identifies the narrowband codebook entry that best matches the extracted feature vector 130, such as the best match to the narrowband spectral envelope extracted from the received signal.

The best match analyzer 135 may employ a comparison of the distances between the extracted feature vector 130 and the index vectors of the narrowband codebook 140 to carry out its function, where the narrowband codebook index vector closest to the extracted feature vector may be selected as the best match. Alternatively, the determination of the best matching entry may comprise mapping the extracted feature vector 130 to a corresponding entry of the narrowband codebook if the extracted feature vector 130 falls within a predetermined distance measure, as, e.g., an Eucledian distance, of a narrowband codebook index vector. If the pre-processing comprises generation of cepstral coefficients, the sum of the squared differences between the coefficients of two sets, one representing the cepstral coefficients of the extracted feature vector 130 and the other one representing the cepstral coefficients of a narrowband codebook index vector entry in the narrowband codebook 140 can be used as the distance measure. Other best match criterion may also be used.

Based on the results of the operations executed by the best match analyzer 135, an entry of the narrowband codebook 140 is selected for further use in the analyzer 120. In the example shown in FIG. 1, the narrowband codebook 140 provides one or more narrowband codebook parameters 145 for use by a signal mapper 150, where the codebook parameters 145 are associated with the narrowband codebook index vector identified by the best match analyzer 135 and, further, may include the selected narrowband codebook index vector. The signal mapper 150 is adapted to execute a mapping function using mapping parameters corresponding to the narrowband codebook parameters. The mapping function may be executed on the extracted feature vector 130 and/or the selected narrowband codebook index vector. The operations executed by the signal mapper 150 result in the generation of an estimated wideband feature vector 155 that may be used to generate a wideband signal that corresponds to the narrowband signal received on channel 110.

Signal mapper 150 may execute one or more of a variety of mapping functions. For example, non-linear mapping of the type used in the context of artificial neural networks may be employed to generate the estimated wideband feature vector 155. Alternatively, or in addition, an affine linear mapping of the extracted narrowband feature vector 130 and/or the narrowband codebook index vector may be employed. Affine linear mapping may include both a linear mapping operation, e.g., rotation or dilation, and a translation operation. It may be used to constitute a rather simple and economic implementation of the signal mapper 150. To this end, signal mapper 150 may employ one or more mapping matrices to execute the linear mapping operations, and one or more translation vectors to execute the translation operations. The matrices and/or translation vectors may be included in the parameters 145 associated with the selected narrowband codebook index vector. Alternatively, the narrowband codebook index vector may be used by the signal mapper 150 to derive the matrices and/or translation vectors used in the mapping operation.

Mapping of the extracted feature vector 130 and/or the narrowband codebook index vector, particularly linear mapping, helps to overcome the problems associated with discontinuous wideband signal generation resulting from the sole use of the discrete entries of codebook pairs. Since the narrowband codebook 140 is effectively used for classifying the extracted feature vector 130 before the mapping operation is executed, the size of the codebook can significantly be reduced (e.g., at least as low as 64 entries).

As noted above, each entry of the narrowband codebook 140 may include the specific mapping parameters that are to be used to generate the estimated wideband feature vector 155. As such, the mapping operations executed by the signal mapper 150 to obtain the estimated wideband feature vector 155 are performed in dependence on the selected narrowband codebook index vector.

Entries for the narrowband codebook 140 may be generated during a training phase. During this training phase, wideband acoustic signals may be passed through a bandpass filter to generate corresponding narrowband acoustic signals. The wideband signals and the corresponding narrowband signals may be analyzed to identify suitable mapping parameters. More particularly, feature vectors corresponding to the narrowband signal may be analyzed to identify their relationship with feature vectors corresponding to the wideband signal with which it is associated. Each entry of the narrowband codebook 140 may include a unique set of mapping parameters and, accordingly, a unique mapping rule can be provided for each entry based on the training data.

In the exemplary system 100, each entry in the narrowband codebook 140 may comprise a mean narrowband feature vector $m_x$, a corresponding mean wideband feature vector $m_y$, as well as a corresponding mapping matrix W. The mean narrowband feature vectors $m_x$ may be used as indices to the corresponding entries of the narrowband codebook 140. The coefficients of the mean narrowband feature vector $m_x$ correspond to the mean value of a range of narrowband feature vectors used during the training phase. The narrowband feature vectors used during the training phase may be of the form $x(n)=(x_0(n), x_1(n), \ldots, x_p(n))^T$ and describe at least one characteristic of a narrowband acoustic signal. For example, the coefficients of the narrowband feature vector x(n) may correspond to predictor coefficients, cepstral coefficients, or line spectral frequencies associated with the original narrowband acoustic signal. Similarly, the coefficients of the mean wideband feature vector $m_y$ correspond to the mean value of a range of wideband feature vectors used during the training phase. The wideband feature vectors obtained during the training phase may be of the form $y(n)=(y_0(n), y_1(n), \ldots, y_q(n))^T$ and correspond to an extended bandwidth version of the narrowband acoustic signal represented by the narrowband feature vector x(n). For example, the coefficients of the wideband feature vector y(n) may correspond to predictor coefficients, cepstral coefficients, or line spectral frequencies associated with the original wideband acoustic signal. The upper index T is used to designate the transposition operation while the subscript q is used to denote the size of each vector. When processing occurs in the time domain, the argument n denotes the time step.

Using the coefficients of the extracted feature vector 130, the best match analyzer 135 may determine which of the mean narrowband feature vectors $m_x$ in the narrowband codebook 140 is closest to the extracted feature vector 130. The mapping parameters associated with the codebook entry indexed by the closest narrowband feature vector $m_x$ may then be used by the signal mapper 150 to generate the estimated wideband feature vector 155. More particularly, in this example, the extracted feature vector 130 is mapped to the estimated wideband feature vector 155, $\hat{y}(n)$, containing the estimated wideband spectral envelope using the following mapping function:

$$\hat{y}(n)=W(x(n)-m_x)+m_y,$$

where $m_x$ is the mean narrowband feature vector identified as the best match to the extracted feature vector 130, W is the mapping matrix entry associated with the mean narrowband feature vector $m_x$, and $m_y$ is the mean wideband feature vector entry associated with the mean narrowband feature vector $m_x$. In this equation, vector $x(n)=(x_0(n), x_1(n), \ldots, x_p(n))^T$ corresponds to the extracted feature vector 130. As such, the estimated wideband feature vector 155,$\hat{y}(n)$, is a function of both the extracted feature vector 130 and the mean narrowband feature vector $m_x$. If desired, however, the foregoing mapping function may be modified so that the estimated wideband feature vector 155 is based on the mean narrowband feature vector $m_x$ and excludes the extracted narrowband feature vector 130 as an operator in the mapping function. Still further, the foregoing mapping function may be modified so that the estimated wideband feature vector 155 is based on the extracted feature vector 130 and excludes direct dependence on the mean narrowband feature vector $m_x$ as an operator in the mapping function. In each instance, however, the mapping parameters are related to the entry of the narrowband codebook 140 that has been selected based on the characteristics of the extracted narrowband feature vector 130.

The matrix W and the translation vector $m_y$ may be obtained during the above-noted training phase. To this end, matrix W may be obtained during the training phase by selecting matrix coefficients for matrix W that minimize an appropriate cost function F(W). The cost function F(W) may be minimized using, for example, a least mean squares approach as follows:

$$F(W)=\sum_{n=0}^{N-1}\|y(n)-\hat{y}(n)\|^2$$

The feature vectors x(n), y(n), and $\hat{y}(n)$ with index n starting from 0 and going up to N−1 are the ones that are associated with a single entry in the narrowband codebook 140. The total number of features N can vary from one codebook entry to another. The sum of all codebook-specific subset sizes N determines the size of the database used by the narrowband codebook 140.

Using the least mean squares approach, an optimized mapping matrix $W_{opt}$ (for F(W)→min) is generated that corresponds to the following:

$$W_{opt}=YX^T(XX^T)^{-1}$$

where $X=[x(0)-m_x, x(1)-m_x, \ldots, x(N-1)-m_x]$ and $Y=[y(0)-m_y, y(1)-m_y, \ldots, y(N-1)-m_y]$.

In this example, each entry of the narrowband codebook 140 refers to a corresponding mapping matrix W and mean wideband feature vector $m_y$. As a result, a reliable and efficient affine linear mapping of the extracted feature vector 130 representing the narrowband spectral envelope a received narrowband signal to an estimated wideband feature vector representing the wideband spectral envelope of the corresponding wideband signal can be realized. The matrix W as well as $m_x$ and $m_y$ that are used in the mapping are related to the selected entry of the narrowband codebook 140 and may be stored in the same database as the narrowband codebook itself.

The estimated wideband feature vector 155 is made available to an audio generator 175 for generation of a wideband acoustic signal that corresponds to a higher bandwidth version of the narrowband acoustic signal received at channel 110. Generation of the wideband acoustic signal may be performed in a number of different manners. For example, the audio generator 175 may synthesize the entire wideband acoustic signal from the estimated wideband feature vector 155. Alternatively, the audio generator 175 may synthesize the wideband acoustic signal by supplementing the received narrowband acoustic signal with extended bandwidth acoustic signal components generated from the wideband feature vector 155. In the latter instance, the audio generator 175 may use the wideband feature vector 155 to synthesize the appropriate lowband and/or highband signal components that are missing from the received narrowband signal. These components may then be added to the received narrowband signal (or its representation) to generate the desired wideband acoustic signal.

As noted above, the signal mapper 150 may implement non-linear mapping techniques instead of linear mapping techniques. During a training phase, the weights for neural networks can be identified and these weights can be related to the entries in the narrowband codebook, as, e.g., the feature vectors comprising the parametric representations of a range of narrowband spectral envelopes.

In some instances, the mapping operations executed by the signal mapper 150 may provide results that are the equivalent to the application of a numerical filter function. For example, the result of the affine linear mapping operations set forth above can be viewed as the application of an all-pole infinite impulse response filter function with recursively determined filter coefficients. If the extracted narrowband feature vector and estimated wideband feature vectors consist of predictor coefficients, the estimated wideband spectral envelope defines an all-pole infinite impulse response filter.

Infinite impulse filter functions may become unstable. Consequently, system 100 may be provided with a stability analyzer 170. Stability analyzer 170 may be used to check the stability of the filter function by monitoring the estimated wideband feature vectors 155 before they are used by the audio generator 175 to generate wideband acoustic signals. If the stability analyzer 170 detects stability in the filter output, it provides the estimated wideband feature vector 155 to the audio generator 175 for further use. However, if the stability analyzer 170 determines that the filter function is unstable, an alternative stable feature vector suitable for use by the audio generator 175 may be made available at the output of the stability analyzer 170. Accordingly, system 100 is provided with a conventional wideband codebook 160 from which a wideband codebook feature vector 165 may be made available to audio generator 175 through analyzer 170 when stability analyzer 170 determines that the filter function has become unstable. In such instances, one or more components of the narrowband codebook index vector 145 may be used as an index into the wideband codebook 160 to select the appropriate wideband codebook feature vector 165 that best corresponds to the extracted feature vector 130. Narrowband codebook 140 and wideband codebook 160 may be designed so that each codebook entry of the narrowband codebook 140 has a corresponding codebook entry in the wideband codebook, and vice versa.

The narrowband and/or wideband codebooks can be generated using speaker-dependent data and/or speaker-independent data. Speaker-independent data can rather easily be obtained and distributed as standard data. Codebooks that are trained in a speaker-dependent way may result in better performance. However, speaker-dependent codebooks require individual generation of the codebook data. Further, the speaker-dependent codebook data has to be transmitted to the receiver side before it can otherwise be made available for wideband signal synthesis.

Figure 2:
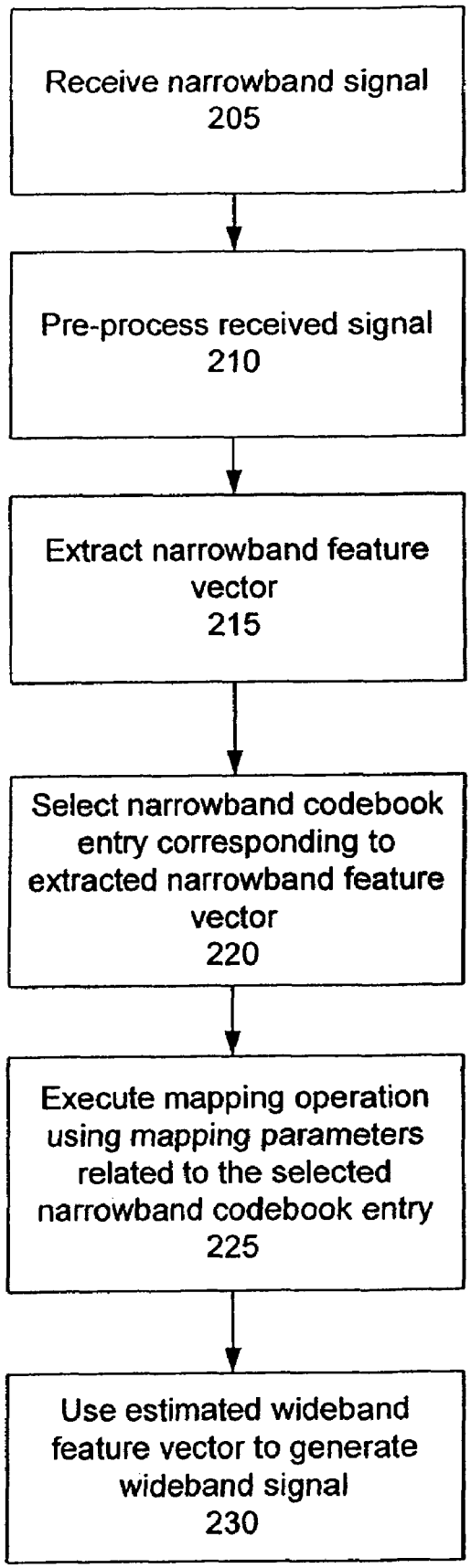
FIG. 2 is a diagram illustrating a number of interrelated operations that may be used in a method to generate wideband signals from received narrowband signals.

FIG. 2 illustrates a number of interrelated operations that may be used in connection with the generation of a wideband acoustic signal from a received narrowband acoustic signal. In accordance with this example, a narrowband acoustic signal is received at block 205 and is subject to optional pre-processing at block 210. The pre-processing operations may include, for example, passing the received signal through a Fast Fourier Transform. Additionally, or alternatively, other signal processing operations may be executed at block 210. These operations may include transformation of the received signal to its corresponding cepstral representation, transformation of the received signal to its corresponding line spectral frequency representation, generation of predictor coefficients from the received signal, and/or generation of a spectral envelope corresponding to the received signal.

An extracted narrowband feature vector is provided at block 215 and may be generated as the result of the processing that takes place when the narrowband acoustic signal is received at block 205 and/or processed at block 210. Alternatively, the extracted narrowband feature vector may be generated using an independent process that is executed at block 215. The extracted feature vector provided at block 215 corresponds to at least one characteristic of the narrowband acoustic signal that is received at block 205. The particular form of the extracted feature vector and its relationship to the original narrowband acoustic signal is dependent on the type and extent of processing executed during reception of the narrowband signal at block 205 and/or pre-processing of the received signal at block 210.

The extracted narrowband feature vector of block 215 is used at block 220 to select a corresponding entry from a narrowband codebook. The entries in the narrowband codebook may be indexed with a range of narrowband vectors, such as narrowband spectral envelopes, that generally correspond to the range of narrowband signals expected at block 205. The operation executed at block 220 may include a comparison between the extracted feature vector 130 and the vector index entries of the narrowband codebook to identify the narrowband codebook entry that best matches the extracted feature vector. For example, the operation executed at block 220 may include a comparison of the distances between the extracted feature vector and the vectors indexed in the narrowband codebook 140 to select the narrowband codebook entry that is indexed by the narrowband codebook index vector closest to the extracted feature vector. Alternatively, the determination of the best matching entry may comprise selection of a narrowband codebook entry if the extracted feature vector falls within a predetermined distance measure, as, e.g., an Eucledian distance, of the narrowband codebook index vector of the narrowband codebook entry. If the pre-processing comprises generation of cepstral coefficients, the sum of the squared differences between the coefficients of two sets of coefficients, one representing the cepstral coefficients of the extracted feature vector and the other one representing the cepstral coefficients of a narrowband codebook vector index entry in the narrowband codebook can be used as the distance measure.

Based on the results of the operations executed at block 220, an entry of the narrowband codebook is selected for use in determining the mapping parameters that are to be used to execute a mapping operation at block 225. For example, a narrowband codebook feature vector may be provided at block 225, where the narrowband codebook feature vector corresponds to the entry of the narrowband codebook that best corresponds to the extracted narrowband feature vector. The narrowband codebook feature vector may include one or more of the actual mapping parameters used in the mapping operations and/or may comprise an index to one or more of the actual mapping parameters in, for example, a database. The mapping function may be executed on the extracted feature vector and/or the narrowband codebook feature vector. The operations executed at block 225 result in the generation of an estimated wideband feature vector that may be used at block 230 to generate a wideband signal that corresponds to the narrowband signal received at block 205.

A variety of mapping functions are suitable for use at the operations of block 225. For example, non-linear mapping of the type used in the context of artificial neural networks may be employed to generate the estimated wideband feature vector. Alternatively, or in addition, an affine linear mapping of the extracted narrowband feature vector and/or the narrowband codebook index vector may be employed. The affine linear mapping may be of the type described above and include both a linear mapping operation, e.g., rotation or dilation, and a translation operation.

Figure 3:
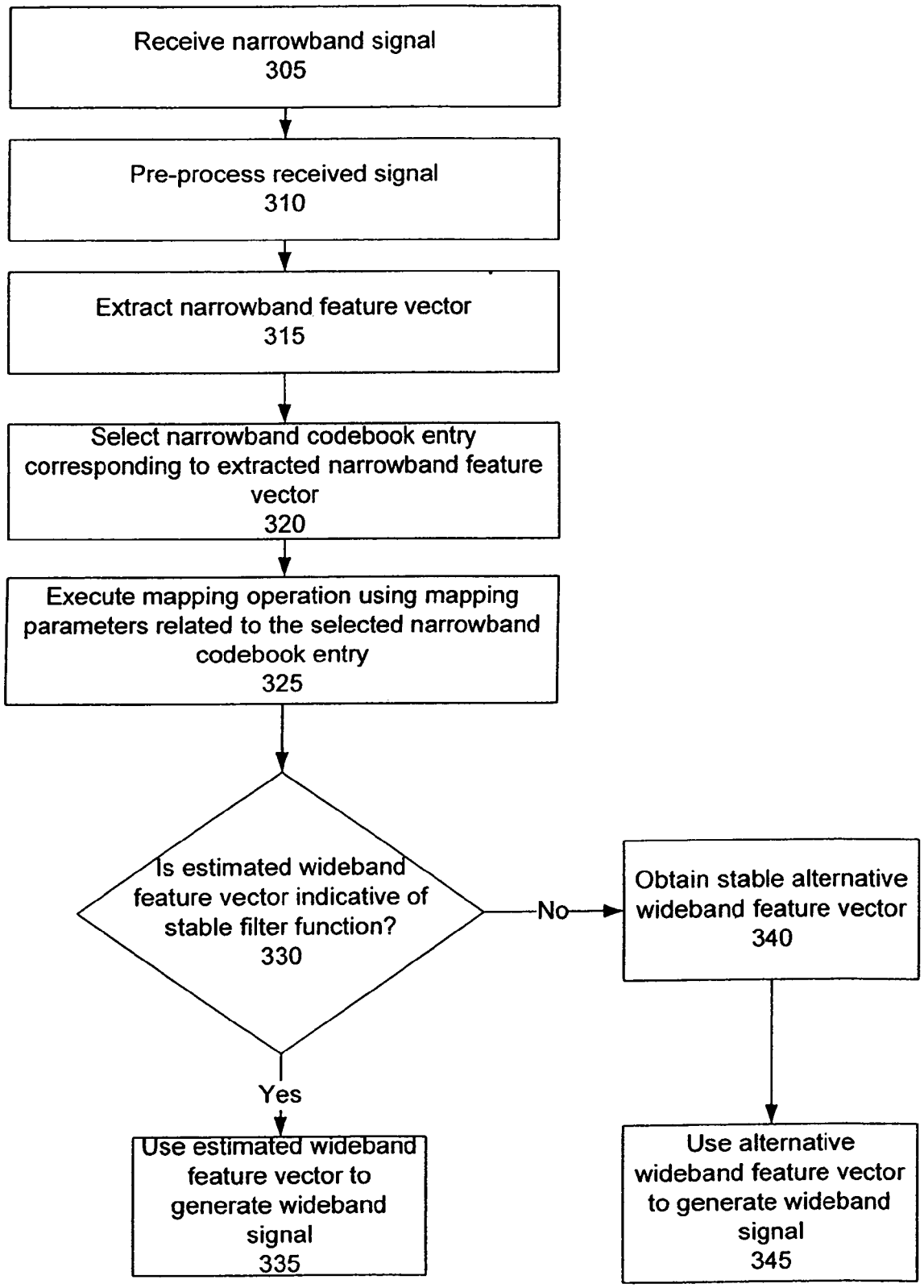
FIG. 3 is a further diagram illustrating a number of interrelated operations that may be used in a method to generate wideband signals from received narrowband signals, where the stability of a filter function constituted by an estimated wideband feature vector is checked before the estimated wideband feature vector is used to generate a wideband signal.

FIG. 3 illustrates a further set of interrelated operations that may be used in connection with the generation of a wideband acoustic signal from a received narrowband acoustic signal. Blocks 305 through 325 may be implemented in substantially the same manner as the operations identified by blocks 205 through 225 of FIG. 2. However, a check is made at block 330 to determine the stability of a filter function constituted by the estimated wideband feature vector. If the filter function is stable, the estimated wideband feature vector is used to generate a wideband signal at block 335. In the event that the filter function is not stable, an alternative stable wideband feature vector is obtained at block 340. The alternative stable wideband feature vector may be obtained in a number of different manners. For example, the alternative vector may be selected from the entries in a wideband codebook. The specific wideband codebook feature vector of the wideband codebook may be selected based on one or more of the parameters of the selected narrowband codebook entry. once a stable alternative wideband feature vector has been obtained at block 340, the vector is used to generate the wideband signal at block 345.

The foregoing systems and methods may be employed in a hands-free set, such as those used in a vehicle. Still further, the systems and methods may also be employed in mobile phone units. Employment in mobile phones and hands-free sets significantly improves the intelligibility of the speech signals produced by these units.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The foregoing systems may be implemented using a combination of hardware and software. To this end, one or more computer programs comprising one or more computer readable media having computer-executable instructions for performing the operations set forth above may be provided for download to a corresponding hardware set.

We claim:

1. A system for use in providing a wideband signal from a received narrowband signal comprising:

an extracted narrowband feature vector corresponding to at least one characteristic of the narrowband signal;

a narrowband codebook having one or more narrowband codebook index vectors, wherein each narrowband codebook index vector corresponds to a narrowband codebook entry;

an analyzer responsive to the extracted narrowband feature vector to identify the narrowband codebook feature index vector that best matches the extracted narrowband feature vector;

a signal mapper for executing a mapping function of the extracted narrowband feature vector using mapping parameters corresponding to the narrowband codebook entry associated with the narrowband codebook index vector identified by the analyzer, wherein the signal mapper generates at least one estimated wideband feature vector through execution of the mapping function;

a stability analyzer for checking stability of a filter function constituted by the estimated wideband feature vector; and a generator responsive to the at least one estimated wideband feature vector to generate a corresponding wideband signal.

2. The system of claim 1, wherein the mapping function executed by the signal mapper comprises an affine linear mapping function.

3. The system of claim 2, wherein the signal mapper comprises a mapping matrix and a translation vector for execution of the affine linear mapping function.

4. The system of claim 1, further comprising:

a wideband codebook responsive to an input vector to provide a wideband codebook feature vector, the input vector having a correspondence to the extracted narrowband feature vector.

5. The system of claim 4, wherein the stability analyzer selects use of the wideband codebook feature vector for generation of the wideband signal when the filter function constituted by the estimated wideband feature vector is unstable, and selects use of the estimated wideband feature vector for generation of the wideband signal when the filter function constituted by the estimated wideband feature vector is stable.

6. The system of claim 1, wherein the received narrowband signal has a spectral envelope, and where the extracted narrowband feature vector corresponds to the spectral envelope of the narrowband signal.

7. The system of claim 1, wherein the received narrowband signal has a spectral envelope, and wherein the narrowband codebook index vector selected by the analyzer corresponds to the spectral envelope of the narrowband signal.

8. The system of claim 1, wherein the wideband signal generated by the generator has a spectral envelope, and where the estimated wideband feature vector corresponds to the spectral envelope of the wideband analog signal.

9. The system of claim 1, wherein the wideband signal generated by the generator has a spectral envelope, and wherein the wideband codebook feature vector corresponds to the spectral envelope of the wideband analog signal.

10. The system of claim 1, wherein the narrowband codebook index vector and for the extracted narrowband feature vector comprise representations of the received narrowband signal selected from a group consisting of predictor coefficients, cepstral coefficients, and line spectral frequencies.

11. The system of claim 1, wherein at least one of the wideband codebook feature vector and the estimated wideband feature vector comprise representations of the wideband signal generated by the generator selected from a group consisting of predictor coefficients, cepstral coefficients, and line spectral frequencies.

12. A system for use in providing a wideband signal from a received narrowband signal comprising:

an extracted narrowband feature vector corresponding to at least one characteristic of the narrowband signal;

a narrowband codebook having one or more narrowband codebook index vectors, wherein each narrowband codebook vector index corresponds to a narrowband codebook entry;

an analyzer responsive to the extracted narrowband feature vector to identify the narrowband codebook feature index vector that best matches the extracted narrowband feature vector;

a signal mapper for executing a mapping function of the narrowband codebook index vector using mapping parameters corresponding to the narrowband codebook entry associated with the narrowband codebook feature index vector identified by the analyzer, where the signal mapper generates at least one estimated wideband feature vector through execution of the mapping function;

a stability analyzer for checking stability of a filter function constituted by the estimated wideband feature vector; and a generator responsive to the at least one estimated wideband feature vector to generate a corresponding wideband signal.

13. The system of claim 12, wherein the mapping function executed by the signal mapper comprises an affine linear mapping function.

14. The system of claim 13, wherein the signal mapper comprises a mapping matrix and a translation vector for execution of the affine linear mapping function.

15. The system of claim 12, further comprising:

a wideband codebook responsive to an input vector to provide a wideband codebook feature vector, the input vector having a correspondence to the extracted narrowband feature vector.

16. The system of claim 15, wherein the stability analyzer is selects use of the wideband codebook feature vector for generation of the wideband signal when the filter function constituted by the estimated wideband feature vector is unstable, and selects use of the estimated wideband feature vector for generation of the wideband signal when the filter function constituted by the estimated wideband feature vector is stable.

17. The system of claim 12, wherein the received narrowband signal has a spectral envelope, and wherein the extracted narrowband feature vector corresponds to the spectral envelope of the narrowband signal.

18. The system of claim 12, wherein the received narrowband signal has a spectral envelope, and wherein the narrowband codebook index vector selected by the analyzer corresponds to the spectral envelope of the narrowband signal.

19. The system of claim 12, wherein the wideband signal generated by the generator has a spectral envelope, and where the estimated wideband feature vector corresponds to the spectral envelope of the wideband analog signal.

20. The system of claim 12, wherein the wideband signal generated by the generator has a spectral envelope, and wherein the wideband codebook feature vector corresponds to the spectral envelope of the wideband analog signal.

21. The system of claim 12, wherein at least one of the narrowband codebook index vector and the extracted narrowband feature vector comprise representations of the received narrowband signal selected from a group consisting of predictor coefficients, cepstral coefficients, and line spectral frequencies.

22. The system of claim 12, wherein the wideband codebook feature vector and for the estimated wideband feature vector comprise representations of the wideband signal generated by the generator selected from a group consisting of predictor coefficients, cepstral coefficients, and line spectral frequencies.

23. A method for use in providing a wideband signal from a received narrowband signal comprising:

in a first computer process, providing a narrowband codebook comprising at least one narrowband codebook index vector associated with one or more narrowband codebook entries;

in a second computer process, receiving at least one narrowband signal;

in a third computer process, extracting at least one narrowband feature vector from the at least one received narrowband signal;

in a fourth computer process, selecting a narrowband codebook index vector that best corresponds to the at least one extracted narrowband feature vector;

in a fifth computer process, performing a mapping operation on the selected narrowband codebook index vector to generate at least one estimated wideband feature vector using mapping parameters related to the narrowband codebook entry associated with the selected narrowband codebook index vector; and in a sixth computer process, checking stability of a filter function constituted by the estimated wideband feature vector.

24. The method of claim 23, further comprising:

generating at least one wideband signal using the at least one estimated wideband feature vector.

25. The method of claim 23, further comprising:

providing a wideband codebook comprising at least one wideband codebook feature vector corresponding to the at least one narrowband codebook index vector;

generating at least one wideband acoustic signal using the at least one estimated wideband feature vector if the filter function is stable; and generating at least one wideband acoustic signal using the wideband codebook feature vector that most closely corresponds to the selected narrowband codebook index vector if the filter function is unstable.

26. The method of claim 23, wherein the mapping operation comprises an affine linear mapping that employs at least one mapping matrix and at least one translation vector.

27. The method of claim 23, wherein at least one of the narrowband codebook index vector and the extracted narrowband feature vector comprise parameter representations of a spectral envelope of the narrowband signal.

28. The method of claim 25, wherein at least one of the wideband codebook feature vector and the estimated wideband feature vector comprise parameter representations of a spectral envelope of the wideband acoustic signal.

29. The method of claim 23, wherein at least one of the narrowband codebook index vector and the extracted narrowband feature vector comprise signal representations selected from the group consisting of predictor coefficients, cepstral coefficients, and line spectral frequencies of the at least one narrowband acoustic signal.

30. The method of claim 25, wherein at least one of the wideband codebook feature vector and the estimated wideband feature vector comprise signal representations selected from the group consisting of predictor coefficients, cepstral coefficients, and line spectral frequencies of the at least one wideband acoustic signal.

31. The method of claim 23, wherein the narrowband codebook comprises speaker dependent data.

32. The method of claim 25, wherein the wideband codebook comprises speaker-dependent data.

33. A method for use in providing a wideband signal from a received narrowband signal comprising:

in a first computer process, providing a narrowband codebook comprising at least one narrowband codebook index vector associated with one or more narrowband codebook parameters;

in a second computer process, receiving at least one narrowband signal;

in a third computer process, extracting at least one narrowband feature vector from the at least one received narrowband signal;

in a fourth computer process, selecting a narrowband codebook index vector that best corresponds to the at least one extracted narrowband feature vector;

in a fifth computer process, performing a mapping operation on the extracted narrowband feature vector to generate at least one estimated wideband feature vector using mapping parameters related to the narrowband codebook parameters associated with the selected narrowband codebook index vector and in a sixth computer process, checking stability of a filter function constituted by the estimated wideband feature vector.

34. The method of claim 33, further comprising:

generating at least one wideband signal using the at least one estimated wideband feature vector.

35. The method of claim 33, further comprising:

providing a wideband codebook comprising at least one wideband codebook feature vector corresponding to the at least one narrowband codebook feature vector;

generating at least one wideband acoustic signal using the at least one estimated wideband feature vector if the filter function is stable; and generating at least one wideband acoustic signal using the wideband codebook feature vector that most closely corresponds to the selected narrowband codebook feature vector if the filter function is unstable.

36. The method of claim 33, wherein the mapping operation comprises an affine linear mapping that employs at least one mapping matrix and at least one translation vector.

37. The method of claim 33, wherein the narrowband codebook feature vector and for the extracted narrowband feature vector comprise parameter representations of a spectral envelope of the at least one narrowband signal.

38. The method of claim 35, wherein at least one of the wideband codebook feature vector and the estimated wideband feature vector comprise parameter representations of a spectral envelope of the wideband acoustic signal.

39. The method of claim 33, wherein the narrowband codebook index vector and for the extracted narrowband feature vector comprise signal representations selected from the group consisting of predictor coefficients, cepstral coefficients, and line spectral frequencies of the at least one narrowband acoustic signal.

40. The method of claim 35, wherein at least one of the wideband codebook feature vector and the estimated wideband feature vector comprise signal representations selected from the group consisting of predictor coefficients, cepstral coefficients, and line spectral frequencies of the at least one wideband acoustic signal.

41. The method of claim 33, wherein the narrowband codebook comprises speaker dependent data.

42. The method of claim 35, wherein the wideband codebook comprises speaker-dependent data.

43. At least one computer readable medium having computer-executable instructions for performing a method, the method comprising:

providing a narrowband codebook comprising at least one narrowband codebook index vector associated with one or more narrowband codebook parameters;

receiving at least one narrowband signal;

extracting at least one narrowband feature vector from the at least one received narrowband signal;

selecting a narrowband codebook index vector that best corresponds to the at least one extracted narrowband feature vector;

performing a mapping operation on the extracted narrowband feature vector and for the selected narrowband codebook index vector to generate at least one estimated wideband feature vector using mapping parameters related to the narrowband codebook parameters associated with the selected narrowband codebook index vector; and checking stability of a filter function constituted by the estimated wideband feature vector.

* * * * *

UNITED STATES PATENT AND TRADEMARK OFFICE

CERTIFICATE OF CORRECTION

PATENT NO. : 7,783,479 B2
APPLICATION NO. : 11/343938
DATED : August 24, 2010
INVENTOR(S) : Bernd Iser et al.

It is certified that error appears in the above-identified patent and that said Letters Patent is hereby corrected as shown below:

In Col. 11, Line 49
replace "is selects use of the wideband codebook feature vector for"
with "selects use of the wideband codebook feature vector for"

Signed and Sealed this

Twenty-third Day of November, 2010

David J. Kappos

David J. Kappos
*Director of the United States Patent and Trademark Office*